United States Patent [19]

Hebert

[11] Patent Number: 4,686,878

[45] Date of Patent: Aug. 18, 1987

[54] NEW ORLEANS WIND CHIMES

[76] Inventor: Barbara A. Hebert, 812 Cameron Ct., Kenner, La. 70065

[21] Appl. No.: 873,212

[22] Filed: Aug. 4, 1986

[51] Int. Cl.[4] ..... G10D 13/08

[52] U.S. Cl. ..... 84/404; 116/141; D11/141; 248/317

[58] Field of Search ..... 84/404, 406, 402; 116/141, 169; D11/141; 248/1, 317

[56] References Cited

U.S. PATENT DOCUMENTS

D. 279,873 7/1985 Neely ..... D11/141 X

D. 285,669 9/1986 Brockman ..... D11/141 X 1,012,560 12/1911 Keller ..... 116/169

FOREIGN PATENT DOCUMENTS 123139 11/1948 Sweden ..... 248/317

*Primary Examiner*—Michael L. Gellner

*Assistant Examiner*—Brian W. Brown

[57] ABSTRACT

A tubular ornamental plastic holder for supporting and holding in place a series of descending ornamental materials. The load carrying portion is at the ends of the tubular plastic holder and a pressure slit designed to hold in place any items that are perpendicular to the load carrying tubular ornamental plastic holder.

2 Claims, 5 Drawing Figures

NEW ORLEANS WIND CHIMES

BACKGROUND OF THE INVENTION

The present invention relates to support systems for holding and supporting ornaments and chimes. Searches throughout Chimes 116 sub title class 141 and mobiles D11 sub title 141 found no patents granted that in anyway resemble the tubular ornamental plastic holder as described.

SUMMARY OF THE INVENTION

The technique of splitting a tubular plastic cylinder and boiling to elastic temperatures has produced a spring-like tension holder to grip and hold chimes and ornaments in place, vertically hung without the need for glues or additional locking devices. The results have provided a means to produce a new and decorative chime and ornamental holder.

BRIEF DESCRIPTION OF DRAWINGS

In the detailed description of the invention presented hereinafter presented, reference is made to the accompanying drawings in which.

DESCRIPTION OF THE EMBODIMENT

Figure 1A:
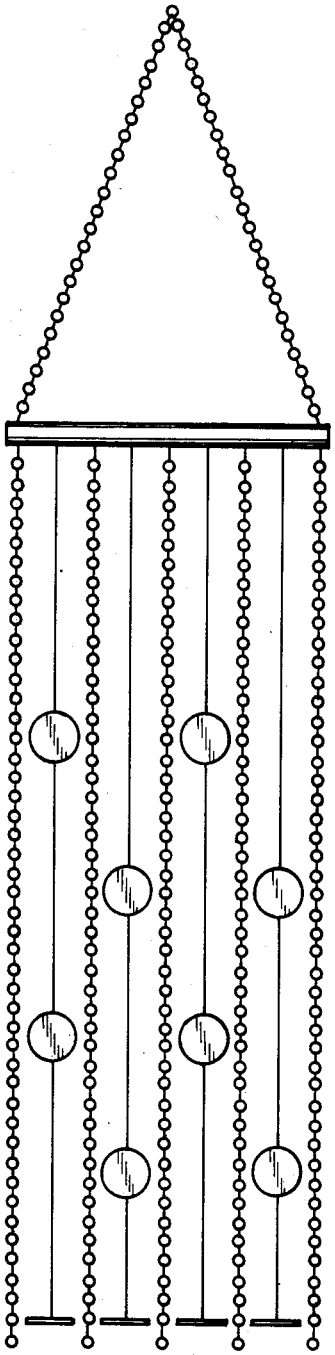
FIGS. 1A and 1B are schematic perspectives, partially in section, of one tubular ornamental plastic holder, supporting a series of ornaments and chimes perpendicular to the holder.
Figure 1B:
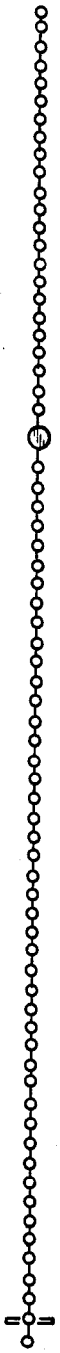
Figure 2A:
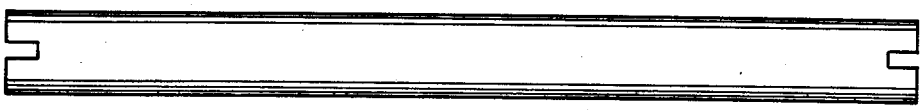
FIGS. 2A, 2B, and 2C are schematics of the tubular plastic mounting apparatus in respective top, bottom and side views of the spring like grip.
Figure 2B:
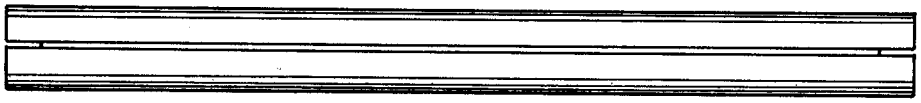
Figure 2C:
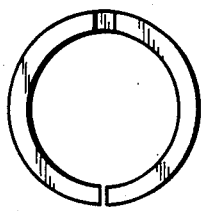

1. Plastic tubular cylinder ½ inch I.D. diameter and 8½ inches in length.

2. A quarter inch slit cut on both ends on upper curvature of the tubular plastic cylinder.

3. A full length slit cut along bottom portion of tubular cylinder.

4. Attachment of upper beads to both ends of mounting apparatus for hanging.

5. Attachments of strings of beads and other decorative ornaments to produce ornaments and bell like chiming sounds from the bottom spring-like grip of the tubular plastic mounting apparatus.

6. It should be appreciated that such dimensions are merely representative of one embodiment and in no way limiting of Inventive Concept. Such embodiment has been described for the purposes of illustration only without any intention of limiting the scope of the invention.

Complete listing of materials used and process for New Orleans Wind Chimes.

For front and side views, see FIG. I.

1. P.V.C. ½ in. (plastic pipe) length 8½ in.
   (a) A full length slit is cut along the full length of the pipe's bottom.
   (b) On the top of the pipe, a quarter-inch slit is cut along each side. See FIG. II.

(c) Pipe is cleaned with sand paper, then steel wool and detergent.
   (d) Water is boiled in a long pan and pipe is submerged for 15 seconds.
   (e) Pipe is then removed and compressed to closed the two top and bottom slits.
2. Monofilament fishing line is cut into 24 inch segments.
   (a) Three knots are tied in top of line and a split shot sinker (size BB) is clamped below the knot.
3. A total of twelve doubloons (four sets of three) are used per chime.
   (a) Two small holes are drilled into eight of the doubloons, one at top and one at bottom.
   (b) One center hole is drilled into the four remaining doubloons.
   (c) The monofilament line is double threaded through the top hole of one of the eight doubloons. Then the line is again threaded through the bottom hole.
   (d) Repeat with a second doubloon.
   (e) The monofilament line is then threaded through the third doubloon (single hole) and secured by three knots and a clamped split shot sinker.
   (f) All doubloons are adjustable.
4. Attachment of beads and doubloons to mounting apparatus (PVC pipe).
   (a) A pair of beads of about 24 inches in length are then slipped through the long bottom slit, followed by one monofilament line (complete with doubloons and sinkers attached).
   (b) Alternate beads and line until chimes correspond with FIG. I.
5. The hanging apparatus.
   (a) One end of a string of beads is slipped through top quarter-inch slit, and other is placed through the remaining quarter inch slit.

What is claimed is:

1. A support for gripping and holding ornamental items, mobiles and chimes without the need for glues or any other locking devices such as tape, nuts or the like comprising: A plastic tubular cylinder having a full length slit. Cut along a first portion thereof, and having two slits, cut at either end along a second portion thereof opposite the first portion, whereby ornamental items, mobiles and chimes may be hung from the slit of the first portion and an upper support may be attached to the two slits on the second portion .

2. A method for making a support for gripping and holding ornamental items, mobiles and chimes comprising the steps of:

slitting a plastic cylinder along a first portion thereof;

placing two slits at either end of the plastic cylinder on a second portion thereof opposite the first portion, dipping the cylinder for a predetermined time in boiling water, hand gripping the cylinder to re-mold the slit portion on the frit portion thereof to grip the ornamental items, mobiles and chimes aligned in suitable positions to allow passage of wind around them to produce a bell-like chime.

* * * * *